United States Patent [19]

Schoblom

[11] 4,092,049

[45] May 30, 1978

[54] LIGHTWEIGHT KNOCKED-DOWN CHAIR DESIGN CONSTRUCTED OF INEXPENSIVE COMPONENTS

[75] Inventor: Svante Schoblom, Tranas, Sweden

[73] Assignee: Overman AB, Tranas, Sweden

[21] Appl. No.: 734,546

[22] Filed: Oct. 21, 1976

[51] Int. Cl.[2] ..... A47C 7/00

[52] U.S. Cl. ..... 297/440; 297/218; 297/219; 297/229

[58] Field of Search ..... 297/218, 219, 229, 440, 297/441, 445, 446, 447, 450; 128/571

[56] References Cited

U.S. PATENT DOCUMENTS

| | | | |
|---|---|---|---|
| 688,664 | 12/1901 | Morand | 128/571 X |
| 3,003,816 | 10/1961 | Wilson | 297/219 |
| 3,517,963 | 6/1970 | Woods et al. | 297/229 X |
| 3,643,997 | 2/1972 | Gilbert et al. | 297/441 |
| 3,887,234 | 6/1975 | Curtis et al. | 297/440 |
| 3,938,860 | 2/1976 | Cobb | 297/440 |

FOREIGN PATENT DOCUMENTS

| | | | |
|---|---|---|---|
| 2,156,778 | 4/1973 | Germany | 297/440 |
| 275,738 | 9/1951 | Switzerland | 297/218 |

*Primary Examiner*—James C. Mitchell
*Attorney, Agent, or Firm*—Louis Weinstein

[57] ABSTRACT

A chair adapted to be packaged, transported and sold in knocked-down (disassembled) fashion and constructed of extremely lightweight and inexpensive components while providing a chair of more than adequate structural strength for normal usage. A pair of uprights are formed from an extremely lightweight relatively soft plastic material such as foamed polystyrene (polyurethane foam) preferably having imbedded therein either cardboard discs or a flat cardboard sheet generally conforming to the outline of each upright for yielding added structural strength; the uprights each being provided with coaligned openings for receiving paper tubes to collectively define an assembled chair frame. The discs or the sheet define the base of each opening. A one-piece fabric cover is stretched over the frame and is tied along the bottom serving as a means for securing the frame pieces in the assembled state, as well as maintaining the fabric spanning the seat and back portions of the chair sufficiently taut to assure comfortable seating thereupon.

17 Claims, 6 Drawing Figures

FIG. 1.
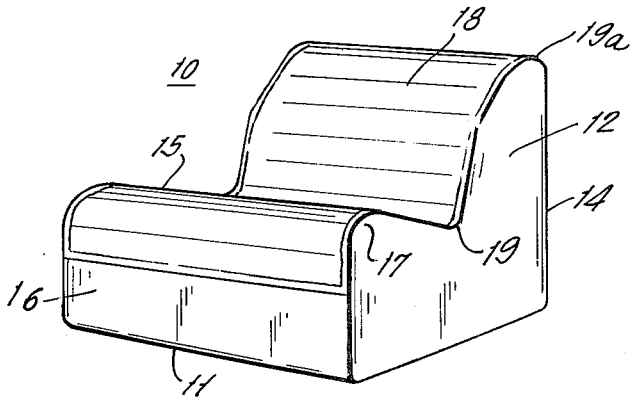
FIG. 3.
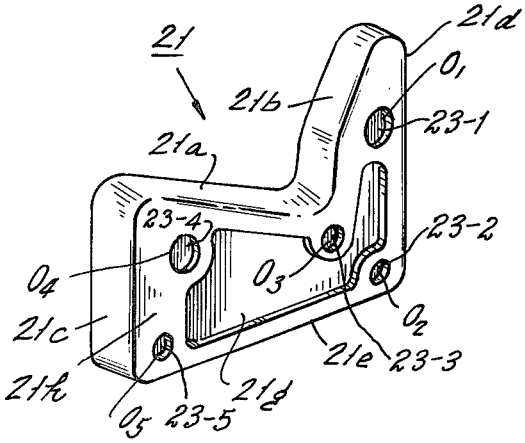
FIG. 2.
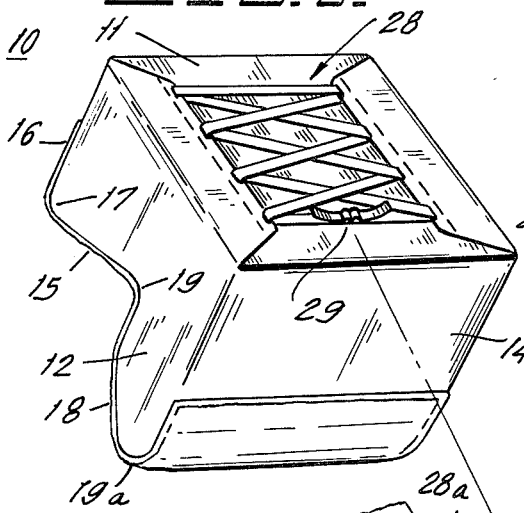
FIG. 4.
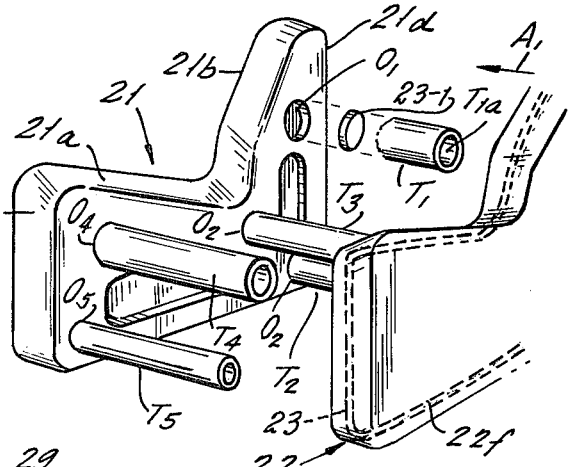
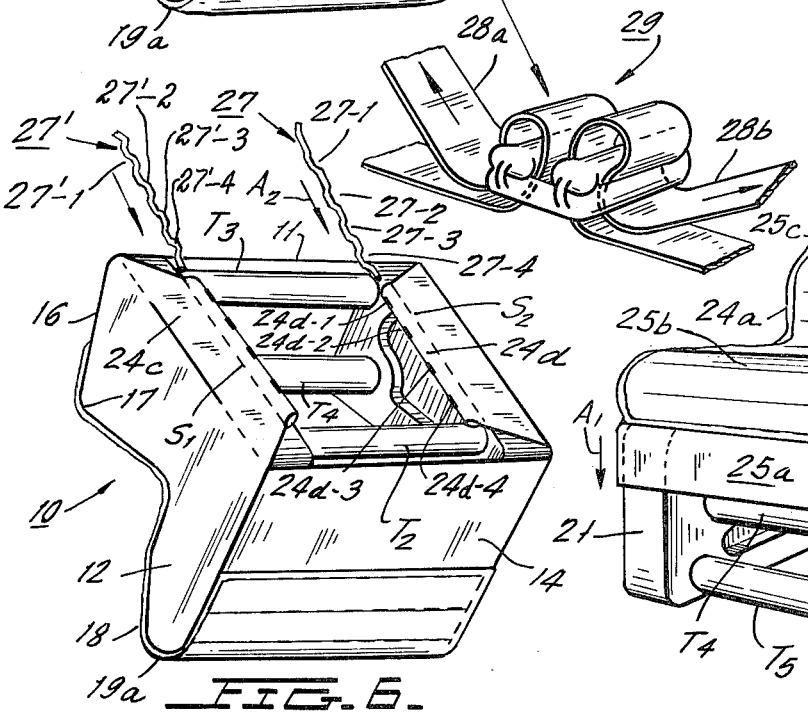
FIG. 6.
FIG. 5.
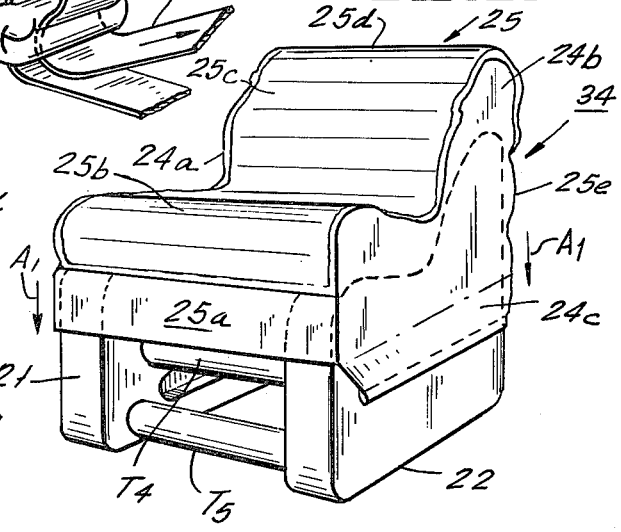

LIGHTWEIGHT KNOCKED-DOWN CHAIR DESIGN CONSTRUCTED OF INEXPENSIVE COMPONENTS

BACKGROUND OF THE INVENTION

The present invention relates to chairs and more particularly to an extremely lightweight and yet structurally strong rugged chair formed of rather inexpensive components and having a design whose simplicity enables the chair to be packaged, shipped and sold in disassembled state and further permitting simple straightforward assembly without the need for any tools whatsoever.

Most, if not all, indoor furniture presently available in the marketplace is fully assembled at the factory thus greatly increasing packaging, storage and shipping costs. In addition thereto, the cost of assembly must also be included in the selling price, as well as the weight of the furniture being a factor with regard to both shipping and handling costs.

Also, with the soaring costs of furniture it becomes extremely difficult to make available furniture to those on limited budgets, which furniture has the combined advantages of providing aesthetically pleasing indoor furniture pieces which are inexpensive from the viewpoints of raw material costs, manufacturing costs, packaging costs, shipping and handling costs and display costs.

A BRIEF DESCRIPTION OF THE INVENTION

The present invention is characterized by admirably meeting all of the above desires by virtue of a design whose simplicity makes all of the above possible, the design comprising inexpensive upright pieces having means for receiving and securing paper tubes to form an assembled chair frame; including a one-piece fabric cover of aesthetically pleasing design, which is stretched over and upon the frame and has its bottom (typically concealed) portion tightly drawn by an interlaced tape to be assured that the fabric is tautly pulled across the seat and back portion of the chair and to also maintain the chair frame components in the fully assembled state.

The nature of the structural components are such as to be capable of being formed of inexpensive raw materials which are also quite inexpensive to fabricate and the design is such that the components of the chair may be simply and readily packaged in a knocked-down fashion, all cooperating to yield a rugged, highly serviceable chair which is quite inexpensive to either manufacture or buy and yet which has more than adequate structural strength and an aesthetically pleasing appearance.

It is therefore one object of the present invention to provide a novel chair having a highly simplified design enabling the chair to be constructed of very inexpensive components and to be packaged, shipped and stored in a fully disassembled state to be simply and readily assembled without the need for any tools whatsoever and to be extremely lightweight and structurally strong.

A BRIEF DESCRIPTION OF THE FIGURES

The above as well as other objects of the invention will become apparent when reading the accompanying detailed description and drawings in which:

FIG. 1 is a front right ¾ perspective view of a fully assembled chair embodying the principles of the present invention;

FIG. 2 is a bottom perspective view of the chair of FIG. 1;

FIG. 3 is a perspective view of one upright employed in the chair frame assembly;

FIG. 4 is an exploded perspective view of the chair frame assembly components and embodying the upright of FIG. 3; and FIG. 5 and FIG. 6 are front ¾ perspective and bottom perspective views which, together with FIGS. 2 and 4, show the developmental steps in the assembly of the chair.

DETAILED DESCRIPTION OF THE INVENTION

FIG. 1 shows a chair 10 designed in accordance with the principles of the present invention and having a substantially flat bottom 11, substantially straight vertical side surfaces 12 and 13 and a substantially straight vertical rear surface 14. The seat portion 15 inclines upwardly toward the straight vertical front surface 16 forming a gentle convex curved portion 17 therebetween. The seat portion 15 conversely slopes downwardly toward the seat-back portion 18 and forms a gentle concave curved portion 19 therebetween. The top portion of the chair has a curved convex contour **19*a* merging with the rear surface 14 of the chair. As can be seen, the fabric completely covers the sides 11 and 12, the seat 15, seat-back 18, top 19*a*, rear surface 14 and front surface 16. From a consideration of FIG. 2, it can be seen that the bottom-most portions of the fabric side pieces (to be more fully described) are drawn across the uprights (to be more fully described) and tautly joined to one another by the lacing arrangement 20**.

The basic structure of the assembled chair frame can best be understood from FIGS. 4 and 7 showing a pair of uprights 21 and 22. Since uprights 21 and 22 can be seen to be substantially identical to one another from the viewpoint of both design and function, only one such upright will be described in detail herein, for purposes of simplicity.

Upright 21 can be seen to have curved surfaces **21*a* and 21*b* which generally conform to the seat and seat-back; 21*c* and 21*d* which conform to the front and rear surface of the fully assembled chair; and 21*e* which serves as the bottom or support for the chair frame which is adapted to be positioned upon a floor or other supporting surface. The surfaces 21*a* and 21*b* are also beveled. The upright member 21 is formed of a relatively inexpensive, rigid cellular plastic foam material, such as, for example, foamed polystyrene, polyurethane foam, polyethylene foam and polyvinylchloride (pvc) foam, which are well known to be quite light in weight and inexpensive while yielding adequate supporting strength. A cardboard element 23 shown in dotted fashion in FIG. 4, is comprised of a substantially stiff paper or cardboard sheet has a contour which generally conforms to the contour of upright 21 may be imbedded into the upright and thereby serves to provide added structural strength for the upright for a purpose to be more fully described. It has been found, however, that the dimensions of the border portion of the upright gives sufficient structural strength to avoid the need for sheet 23**.

The outer surface of upright 21 (see surface **22*f* of upright 22 in FIG. 4) is substantially flat and smooth, while the opposite or interior surface is provided with an indentation or shallow cutaway portion 21*g* which serves to reduce the amount of plastic material required while maintaining the overall thickness around the marginal or border region 21*h*. The thicker marginal or border region 21*h* is provided with a plurality of openings $O_1 - O_5$ each being adapted to receive one end of a hollow cylindrical paper tube $T_1 - T_5$, respectively, as can best be seen in FIG. 4. There is in place of the cardboard sheet 23, a plurality of discs 23-1 through 23-5** inserted into each opening to prevent the tubes from piercing the plastic upright.

Considering both FIGS. 4 and 3, the tubes $T_1 - T_5$, which are formed of a suitable cardboard are, hollow tubular members and are initially force-fitted, for example, into the openings $O_1 - O_5$ in upright 21. Although the cylindrical tubes can be seen to be of different diameters, tubes of the identical diameter may be utilized if necessary. Since the tubes $T_1$, $T_3$ and $T_4$ support the major load imposed upon the chair when someone is seated thereon, these tubes are of the greatest diameter and, in fact, tubes $T_1$, $T_4$ are larger in diameter than the tube $T_3$, tubes $T_2$ and $T_5$ being the tubes having smallest diameters. One distinct advantage of this arrangement resides in the fact that for packaging, transportation and storage purposes, tube $T_5$ may be inserted and telescoped into tube $T_4$; $T_2$ may be inserted into tube $T_3$ and these two tubes may, in turn, be inserted into the interior of tube $T_1$ so that, in actuality, the total space occupied by the tubes constitutes no more than the space that would be occupied by tubes $T_1$ and $T_4$. As a practical matter, and if desired, tube $T_1$ may be designed to be one of the largest diameter, tube $T_4$ may be of the next largest diameter and slightly smaller than tube $T_1$; tube $T_3$ may be of slightly smaller diameter than $T_4$, and so forth so that all of the tubes may be received by tube $T_1$ thus requiring only the amount of space necessary for a single tube, i.e., tube $T_1$ thereby significantly reducing the amount of space occupied by the individual components when packaged.

After assembly of each of the ends of the tubes $T_1 - T_5$ into the appropriate openings $O_1 - O_5$ of upright 21, the upright 22 is then aligned so that its openings (not shown for purposes of simplicity) are axially aligned with the openings $O_1 - O_5$ in upright 21 and then the upright 22 is moved or pressed toward upright 21 in the direction of arrows $A_1 - A_1$ so that the opposite ends of tubes $T_1 - T_5$ are force-fittingly received within the openings provided in upright 22, thereby forming a fully assembled chair frame. The tubes are preferably force-fitted into the openings to a depth so that their free ends (for example, the free end $T_{1a}$ of tube $T_1$) abut against the cardboard insert (for example, the cardboard discs 33) inserted in the openings of upright 22. Since each of the tubes T are preferably of equal length, the uprights 21 and 22 are maintained in spaced parallel fashion.

After having once assembled the chair frame, the single one-piece cover 23 (see FIG. 5) which may be formed of a suitable fabric or plastic, is pulled over the frame in the direction shown by arrows A1. As can clearly be seen, the fabric cover is preferably formed of a pair of side panels **24*a* and 24*b* having perimeters which substantially generally conform to the perimeters of the uprights against which they ultimately rest. The center or main panel 25 is sewn to the uprights substantially along the front side, top side and back side perimeters so as to form the front side 25*a*, seat 25*b*, back 25*c*, top 25*d* and rear surface 25*e* portions of the completed chair assembly. Preferably, the sections 25*b*, 25*c* and 25*d*, which form the region upon which a person sits, may be reenforced with an additional fabric panel of a suitable material sewn to the central panel 25** along the interior side of the cover to provide additional structural supporting strength for the seat.

The side panels **24*a* and 24*b* are each provided with downwardly depending portions 24*c* and 24*d* which are pulled down and around the bottom surfaces of uprights 21 and 22 as can best be seen in FIG. 6, so as to form a pair of cooperating flaps. Each of the flaps has its free edge bent over and back again upon the flap and is then sewn to the body of the flap as represented by the stitch marks S1 and S2 whereby a pair of hollow sleeves are formed by this construction. The innermost facing edges of these sleeves are slitted such as, for example, at 24*d*-1, 24*d*-2, 24*d*-3 and 24*d*-4 so as to form slits or openings at spaced intervals along the sleeve. An elongated metallic rod 27 and 27' is inserted into each of the aforementioned sleeves. Each rod is provided with a plurality of bends so as to form a plurality of substantially U-shaped portions 27-1, 27-2, 27-3 and 27-4 (as well as 27'-1 - 27'-4), which bends are in substantially exact alignment with slits 24*d*-1 through 24*d*-4 respectively when the rod 27 is inserted within its associated sleeve (by aligning the rod and slipping it into the sleeve in the direction shown by arrow A2). As a result, each of the U-shaped portions 27-1 through 27-4 (and 27'-1 through 27'-4) extend through the associated slit so as to form eyelets. An elongated tape 28 is laced or otherwise threaded through these eyelets in a manner shown best in FIG. 2 and a tightening assembly 29, shown best in the inset portion of FIG. 2, receives the free ends 28*a* and 28*b* of the tape so as to permit the lacing structure to be tightened to the extent necessary in order to maintain the fabric covering sufficiently taut about the chair frame assembly. It should of course be understood that the chair frame cover 25 should initially be tightly drawn about the frame before tightening the tape 28. In this manner, the seat and back portions 25*b* and 25*c* are "slung" between the uprights and are actually suspended above the upper ends of tubes $T_1$, $T_3$ and $T_4$ so as to make no contact whatsoever with these tubes when someone is seated on the chair and thereby render the seat comfortable to the user. Since fabric is known to "give" after certain periods of use, this possibility may be fully compensated for by loosening the laced tape 28, pulling the covering so as to draw the sleeves more closely toward one another to compensate for the loosening or the give experienced by the fabric, and then retightening and refastening the lacing in the same manner in which it was originally secured. This structure assures that the fabric (or plastic) covering remains in position and with sufficient tautness, as well as assuring that the lightweight frame assembly remains in the assembled condition. Thus, it can be seen that the only fastening means per se is the laced tape 28, all other conventional types of fastening means being totally eliminated. The force-fitting arrangement between the tubes T and the uprights 21 and 22** need not be overly tight since the combination of the fabric cover, which is preferably made so as to initially provide a tight fit, and the laced tape serves to provide the necessary holding strength for maintaining the chair in the fully assembled condition.

The chair, when fully assembled, in addition to providing more than adequate structural and supporting strength, provides a chair which is quite aesthetically appealing in appearance and which is extremely light in weight and is quite inexpensive from the viewpoint of cost of raw materials, the cost of packaging, shipment and storage, as well as enabling the purchaser to eliminate the need for factory assembly due to the fact that the simplicity of design enables the purchaser to assemble the chair in a fast, simple and straightforward manner.

In one typical example, the unique design of the chair is such as to permit it to be packaged within a carton whose length and width are respectively equal to the height and width of the chair; whose width is equal to double the width of one upright (i.e., the width of two uprights standing side-by-side), there being more than adequate room in the remaining hollow interior region of the carton defined by the carton side and top walls and the surfaces 21*a* and 21*b* (and 22*a* and 22*b*) of the uprights 21 and 22 for insertion and storage of the fabric cover (which may be neatly folded into a small compact package); the paper tubes $T_1 - T_5$; the elongated tape 28 and the small clamping member 29; and the tube eyelet-defining rods 27 and 27', as well as a single instruction sheet. A chair, fully assembled, and conforming to the embodiment recited hereinabove and having a height of 26½ inches, a width of 26 inches and a depth of 29 inches weighs of the order of 8 lbs. In the fully assembled state within a carton and including the carton, the chair weighs approximately 9 lbs. The package is quite compact, having an overall dimension of 8 × 26 × 30 inches. It can thus be seen that the package is extremely light in weight, is capable of taking a reasonable amount of punishment in the storage, transportation and other handling thereof, has a frame assembly formed of extremely inexpensive components and yet is quite structurally strong, is light in weight and yields a rather aesthetically pleasing appearance.

Although there has been described a preferred embodiment of this novel invention, many variations and modifications will now be apparent to those skilled in the art. Therefore, this invention is to be limited, not by the specific disclosure herein, but only by the appended claims.

What is claimed is:

1. An extremely lightweight and yet structurally strong and rugged chair assembly whose design completely eliminates the need for conventional fastening means comprising a pair of uprights formed of extremely lightweight, rigid foamed plastic material;

each of said uprights having a perimeter whose configuration defines the front surface, seat portion, seat back portion, rear surface and bottom surface of the completed chair and each of said uprights having an interior surface provided with openings of a predetermined depth;

a plurality of hollow cylindrical paper tubes, each being inserted within a cooperating pair of openings of said uprights so that, when fully assembled, said tubes maintain the uprights in a spaced substantially parallel fashion;

a single one-piece fabric cover being pulled over the chair frame assembly and adapted to cover the front, rear, left and right-hand surfaces of the chair assembly, as well as the seat, back and top portions and further adapted to have a pair of flaps which are pulled about the bottom surfaces of the uprights;

means threadedly engaging said flaps for tautly maintaining the cover assembly about said chair frame assembly whereby only the uprights engage the cover and further maintain the cover a spaced distance from all of said tubes, even under the weight of a person using the chair.

2. The chair assembly of claim 1, wherein said uprights are each provided with a flat, stiff cardboard sheet imbedded within the upright and having a contour generally conforming to the contour of the upright for increasing the structural supporting strength of the upright.

3. The chair assembly of claim 2, wherein central portions of the surfaces of said uprights confronting one another, when in the assembled state, are removed to form recesses therein which serve to reduce the amount of material used to form the upright and hence serve to reduce the weight of the upright while the portions surrounding said recesses have a greater thickness to provide adequate supporting strength.

4. The chair assembly of claim 1, wherein said hollow cylindrical tubes are of different diameters thereby enabling at least selected ones of said tubes to be telescopingly received within remaining ones of said tubes, when in the disassembled state, thereby reducing the amount of space occupied by the tubes when in the packaged for shipment and storage to the total space required for the two tubes of largest diameter.

5. The chair assembly of claim 1, wherein all of said tubes are hollow and are of different diameters to enable each tube of smaller diameter to be telescopingly received within the tube of the next largest diameter so that, when stored, it is possible to have all of said tubes occupy a total space no greater than the space occupied by the tube having the largest diameter.

6. The chair assembly of claim 1, wherein said covering flaps are each provided with a plurality of eyelets arranged at spaced intervals along their free edges and lacing means threaded through said eyelets wherein the free ends of said lacing means may be tied together to maintain the covering means taut on said chair frame assembly.

7. The chair assembly of claim 1, wherein the flaps are each provided with hollow sleeves having a plurality of slits arranged at spaced intervals along said slits;

an eyelet forming rod inserted into each of said sleeves, each rod having a plurality of substantially U-shaped portions each aligned with an associated one of said slits and each adapted to extend through a slit when the rod is fully inserted into its associated sleeve so as to form eyelets;

an elongated lacing member being threaded through the eyelets which are formed by the U-shaped portions projecting through said slits and having the free ends of said elongated lacing member tied together to maintain the covering member taut about said chair assembly.

8. The chair assembly of claim 7, wherein releasable fastening means are provided for receiving the free ends of said lacing means to facilitate selective tightening or loosening thereof.

9. The chair assembly of claim 1, wherein said uprights are formed of foamed polystyrene.

10. The chair assembly of claim 1, wherein the uprights are formed of polyurethane foam.

11. The chair assembly of claim 1, wherein said covering member is formed of first and second side fabric pieces respectively covering the outer surfaces of said first and second uprights; an intermediate fabric piece being joined to said side fabric pieces and defining the front surface, seat surface, seat back surface, seat top surface and rear surface of the chair assembly;

the bottom edges of said side panels extending below the side surfaces of said uprights and defining said flaps.

12. The chair assembly of claim 11, wherein said intermediate fabric panel is provided with a reenforcing sheet sewn thereto at least in the region of said seat portion so as to provide added strength in the region of the seat portion slung between said uprights to withstand the weight of a body seated thereon as is normally encountered during conventional use.

13. The chair assembly of claim 2, wherein the bottom surfaces of the holes in said upright are all defined by one surface of said sheet to limit the depth to which each of said tubes may be inserted into their associated openings.

14. The chair assembly of claim 1, wherein stiff disc-shaped members are inserted into each opening to prevent the tubes inserted into the openings from piercing or damaging the upright.

15. The chair assembly of claim 1, wherein said uprights are formed of a rigid cellular plastic foam.

16. The chair assembly of claim 15, wherein the uprights are formed of polyurethane foam.

17. The chair assembly of claim 15, wherein the uprights are formed of polyvinylchloride (pvc) foam.

* * * * *

UNITED STATES PATENT AND TRADEMARK OFFICE

CERTIFICATE OF CORRECTION

PATENT NO. : 4,092,049

DATED : May 30, 1978

INVENTOR(S) : Svante Schoblom

It is certified that error appears in the above-identified patent and that said Letters Patent are hereby corrected as shown below:

Column 3, line 61, "23" should read --34--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*